US005314304A

United States Patent [19]

Wiebe

[11] Patent Number: 5,314,304

[45] Date of Patent: May 24, 1994

[54] ABRADEABLE LABYRINTH STATOR SEAL

[75] Inventor: David J. Wiebe, Palm Beach Gardens, Fla.

[73] Assignee: The United States of America as represented by the Secretary of the Air Force, Washington, D.C.

[21] Appl. No.: 745,630

[22] Filed: Aug. 15, 1991

[51] Int. Cl.[5] ..... F01D 11/08

[52] U.S. Cl. ..... 415/173.4; 415/174.4; 277/53; 277/DIG. 6; 428/593; 428/632

[58] Field of Search ..... 415/170.1, 173.4, 174.4; 277/53, 55, 56, 57, DIG. 6; 428/593, 632, 633

[56] References Cited

U.S. PATENT DOCUMENTS

| | | | |
|---|---|---|---|
| 3,053,694 | 9/1962 | Daunt et al. | 415/173.4 |
| 3,423,070 | 1/1969 | Corrigan | 415/173.4 |
| 3,970,319 | 7/1976 | Carroll et al. . | |
| 4,135,851 | 1/1979 | Bill et al. | 415/173.4 |
| 4,218,066 | 8/1980 | Ackermann | 415/174.4 |
| 4,409,054 | 10/1983 | Ryan | 415/173.4 |
| 4,460,311 | 7/1984 | Trappmann et al. . | |
| 4,525,998 | 7/1985 | Schwarz . | |
| 4,662,821 | 5/1987 | Kervistin et al. . | |
| 4,936,745 | 6/1990 | Vine et al. | 415/173.4 |

*Primary Examiner*—Edward K. Look
*Assistant Examiner*—Christopher Verdier
*Attorney, Agent, or Firm*—Donald J. Singer; Thomas C. Stover

[57] ABSTRACT

In a gas turbine engine having a laybrinth seal between an annular rotor and stator therein, in which the stator is surmounted by a honeycomb structure and the rotor has a knife edge which is mounted to rotate in close annular proximity with said honeycomb structure, an improvement is provided wherein such labyrinth seal has a layer of abradeable coating atop the honeycomb structure for the rotor knife edge to rotate proximate thereto and to rub in, without substantially damaging the knife edge nor the honeycomb structure. In one embodiment the layer of abradeable coating is mounted on a metalic foil which is mounted in turn, atop the honeycomb structure. The abradeable coating thus provided, is more yieldable and less damaging to a rotor knife edge than is the honeycomb structure of the prior art, to better preserve rotor and stator and thus the labryrinth seal. Because of such protection, the rotor knife edge can be thinner and of lighter weight and the honeycomb structure can be made of larger cell sizes, again resulting in weight savings for each lab seal, which can have one or a plurality of rotor (knife edge)-stator pairs. Further, the abradable coating seals the top of the honeycomb structure and thus blocks air flow into the honeycomb cells beneath and behind the knife edge and thus reduces losses in seal efficiency.

14 Claims, 2 Drawing Sheets

ABRADEABLE LABYRINTH STATOR SEAL

STATEMENT OF GOVERNMENT INTEREST

The invention described herein may be manufactured and used by or for the Government for governmental purposes without the payment of any royalty thereon.

BACKGROUND OF THE INVENTION

1. Field of the Invention

This invention relates to labyrinth stator seals particularly those having an abradeble layer thereon.

2. The Prior Art

Labyrinth (lab) seals are used to minimize gas leakage between rotating and static parts in gas turbine engines. In order to minimize steady state clearances, the initial clearance between knife edge and honeycomb is set very tightly, which usually results in a rub therebetween during transient engine operation. Thus in the typical lab seal knife edge rotor - honeycomb stator, the knife edge sets its own running clearance by wearing grooves into the honeycomb. Because of such rubbing, the rotor knife edge has to be relatively thick so that it can rub into the honeycomb and not have excessive wear at such knife edge. During such rub, the rotor knife edge is greatly heated with respect to the rest of the rotor. This causes a strong temperature gradient and high stress in such rotor which has caused rotors to crack and break off in certain engines, e.g. per crack 13 in FIG. 3 hereof, which (resulting gap) of course, can signifcantly impair the seal efficiency and operation of such engines.

In the prior art certain attempts have been made to improve the clearance control between rotor and outside annular stator, by blowing air against the outside surface of the stator, to reduce the annular air seal operating clearance. See, U.S. Pat. No. 4,460,311 to Trappmann et al. (1984), U.S. Pat. No. 4,525,998 to SWARZ (1985) and U.S. Pat. No. 4,662,821 to Kervistin et al. (1987). In another reference, blade tips abrade an outer annular slotted metal strip assembly, which is porous to admit air therethrough; see U.S. Pat. No. 3,970,319 to Carroll (1976). None of the above references attempts an improved lab seal between rotor knife blade and stator by providing a abradeable stator wear seal, that is protectively yielding to the rotor knife edges while providing a relatively non-porous stator seal surface and without relying upon clearance control mechanisms.

Accordingly there is a need and market for an improved lab stator seal that reduces rotor knife edge thermal gradients and stress and otherwise obviates the above prior art shortcomings.

There has now been discovered an improved lab stator rubbing surface or seal that reduces the wear, heat-up and resulting cracking of the rotor knife edge and reduces damage to the underlying honeycomb structure.

SUMMARY OF THE INVENTION

Broadly the present invention provides, in a gas turbine, having a lab seal between a rotor and stator therein, in which the stator is surmounted by a honeycomb structure and the rotor has a knife edge which is mounted to rotate in close proximity with such honeycomb structure, the improvement comprising, an abradeable coating mounted atop the honeycomb structure that is of softer material than such honeycomb structure and allows the rotor knife edge to rub into it without excessive heat build-up and with reduced wear to the knife edges.

In another embodiment a metallic foil is mounted atop the honeycomb and the layer of abradeable coating is mounted atop such foil.

The abradeable coating can be of ceramic material such as zirconium oxide or magnesium zirconate, which is softer or offers less resistance during rubbing than the honeycomb structure.

In addition to protecting the rotor knife edge, the abradeable coating blocks airflow under the rotor knife edges, into the honeycomb and up and out the reverse side of such knife edge per arrow FIG. 17 of FIG. 5, which causes a significant drop in lab seal efficiency.

BRIEF DESCRIPTION OF THE DRAWINGS

The invention will become more apparent from the following detailed specification and drawings in which.

DESCRIPTION OF THE PREFERRED EMBODIMENTS

Figure 1:
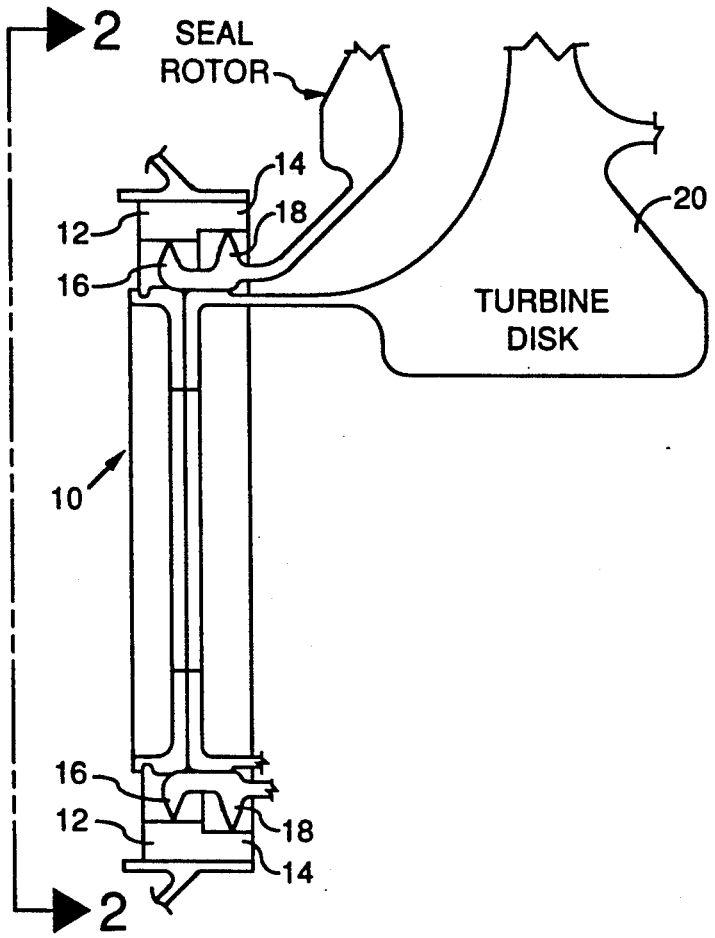
FIG. 1 PRIOR ART
FIG. 1 is a schematic sectional elevation view of lab stator seals and the rotor knife edges of the prior art.
Figure 2:
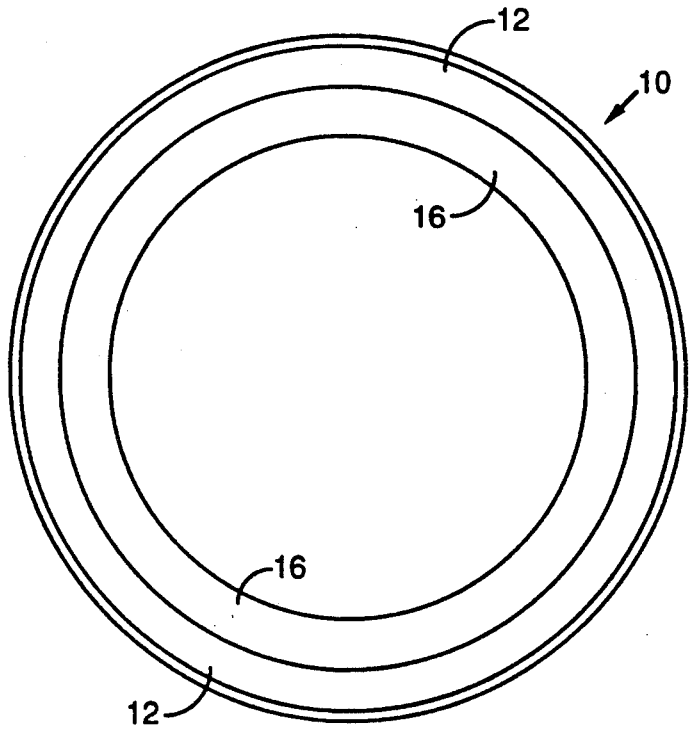
FIG. 2 PRIOR ART
FIG. 2 is a front elevation view of the rotor and stator of FIG. 1, taken on lines 2—2, looking in the direction of the arrows.

Referring now in more detail to the drawings, prior art labyrinth seal 10 has annular stator honeycombs 12 and 14 and annular rotor knife edges 16 and 18, which rotate in close proximity and/or rub their associated honeycomb seals 12 and 14, as shown in FIGS. 1 and 2. The annular rotor knife edges 16 and 18 are mounted on (and rotated by) turbine disc 20 (which carries turbine blades thereon, not shown), as shown in FIG. 1.

Continuing in the prior art, in the typical rotor knife edge with a honeycomb stator, the knife edge rubs or wears grooves into the honeycomb. Accordingly, the rotor knife edge needs to be relatively thick so that it does not sustain excessive wear. During the "rub" the rotor knife edge is greatly heated, causing the rotor to thermally expand which can cause deeper rubbing into the honeycomb stator seal. Also during transient conditions in the gas turbine, the knife edges of the rotor can make greater incursions into the honeycomb stator seal, e.g. during engine acceleration or deceleration.

Figure 3:
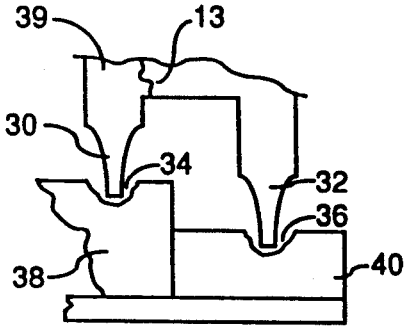
FIG. 3 PRIOR ART
FIG. 3 is a fragmentary elevation schematic view of prior art rotor and stator components.

Thus prior art rotor knife edges 30 and 32 rub deep incursions 34 and 36 into the honeycomb stator seals 38 and 40, which considerably opens the seal under such knife edges 34 and 36 (for gas escape thereunder), as shown in FIG. 3.

Also the above-mentioned heating up of the rotor knife edge, e.g. knife edge 30, relative to its cooler rear portion 39 (FIG. 3), can cause a severe thermal gradient to build up, cause the rotor to crack at, e.g., fault line 13 and break off, greatly impairing such lab seal.

Figure 4:
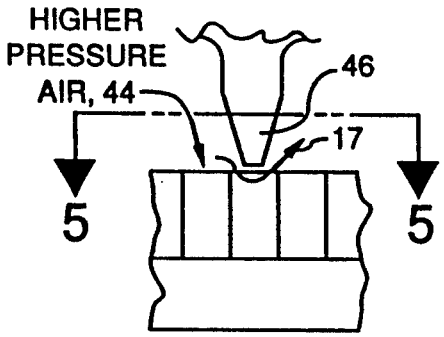
FIG. 4 PRIOR ART
FIG. 4 is a fragmentary elevation schematic view of rotor and stator of the prior art.
Figure 5:
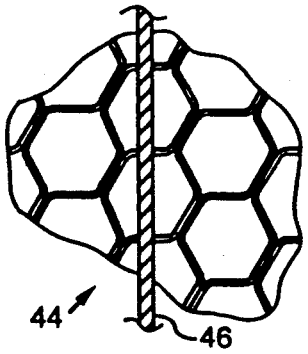
FIG. 5 PRIOR ART
FIG. 5 is a fragmentary plan schematic view of the prior art components of FIG. 4, taken on lines 5—5, looking in the direction of the arrows.
Figure 6:
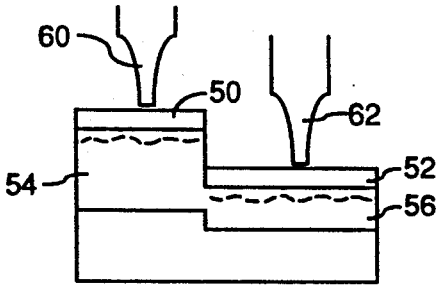
FIGS. 6 and 7 are fragmentary elevation schematic views of rotor and stator components of the present invention.

Another problem with the prior art seals is illustrated in FIGS. 4 and 5. That is, the open cell honeycomb 44 provides a leakage path for air or other gas, under the rotor knife edge 46, per arrow 17, as shown in FIGS. 4 and 5. The present invention solves the above problems by providing layers of relatively soft, abradeable coating 50 and 52, across the stator honeycomb 54 and 56, as shown in FIG. 6, so that the rotor knife edges 60 and 62 will rub into such coating instead of immediately into into the honeycomb structure,as is the practice with the prior art.

Figure 7:
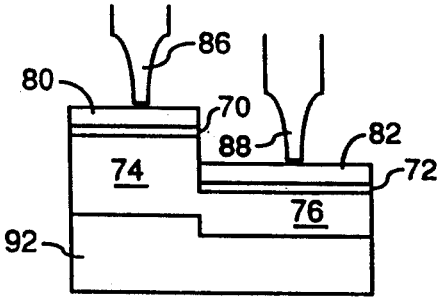
Figure 8:
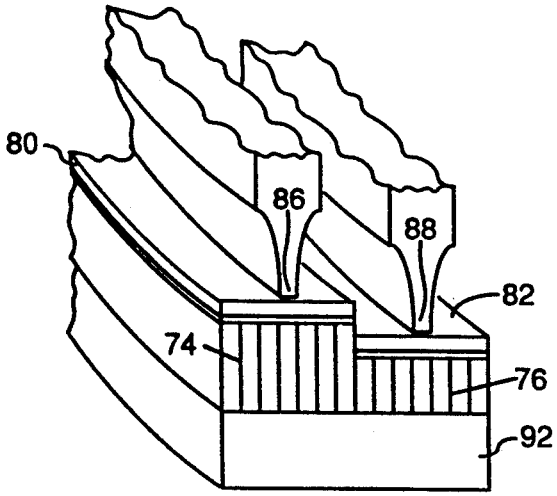
FIG. 8 is a perspective view of the rotor and stator components of FIG. 7
Figure 9:
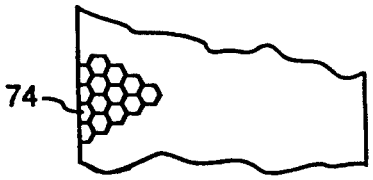
FIG. 9 is a fragmentary cross-sectional view of stator components of FIG. 8.

Another embodiment of the invention is shown in FIG. 7, wherein metallic foil layers 70 and 72, are mounted atop honeycomb structures 74 and 76 respectively and layers of abradeable coating 80 and 82, are mounted over the respective foil layers 70 and 72 per FIG. 7. Thus the rotor knife edges 86 and 88 can rub into the abradeable coating 80 and 82 respectively (of the stator) rather than into and through the more resistant, underlying honeycomb structure 74 and 76, as shown in FIGS. 7, 8, and 9.

The metallic foil or other support layer, provides a surface upon which to apply the layer of abradeable coating. The coating is desirably in the thickness range of about 0.01–0.040 in. and provides an abradeable surface for the rotor knife edges to rub in, without significant damage to such knife edges or to the stator honeycomb structure.

Thus as indicated, the invention provides at least two embodiments of lab stator seal; 1) a honeycomb structure with a layer of abradeable coating directly applied theron and 2) a honeycomb structure with a support layer (e.g. foil) mounted thereon, surmounted by such layer of abradeable coating, as discussed above.

Preferably such support layer is a metallic foil which can be readily brazed or resistance welded to the top of a metal honeycomb structure.

The metal honeycomb structure can in turn, be brazed or otherwise attached to the support member 92 therebelow, shown in FIGS. 7 and 8.

Another pay off or advantage of the present invention is that providing one or more layers atop the honeycomb structure, can eliminate the gas or air leakage path under the knife edge, by way of previously uncovered honeycomb cells per the lab seal stators and rotors of the prior art. That is, an advantage of mounting one or more layers across the honeycomb of the stator is that it can eliminate the losses in seal efficiency due to air or gas flowing down into a honeycomb cell and exiting behind the rotor knife edge. Prior Art lab seals employ high density, small cell size honeycomb to minimize air leakage. However, small cell size honeycomb adds expense and weight to the lab seal and also makes the honeycomb more resistant to rubbing, causing more heat induced stress in the knife edges.

A desired feature of this invention is that the layer of abradeable coating be preferably only as thick as the anticipated "normal conditions" rub-in and the honeycomb underneath, provides damage tolerance protection against a deep rub caused by conditions such as compressor surge. In an event of a deep rub, the thin foil and honeycomb would be grooved with minimal or no damage to the knife edge of the rotor. The relatively thin coating would not be susceptible to chipping or cracking. This combination of honeycomb with a thin layer of coating, is considerably superior to a single thick layer of coating applied directly to a metal stator support ring, since a thick layer of coating would be susceptible to cracking and chipping out in large pieces.

Another advantage is that each rotor knife edge can be thinner than those of the prior art, since rubbing the coating will require less energy than rubbing the honeycomb structure of the stator. Prior Art rotors have relatively thick tips or knife edges so that they can grind into the honeycomb stator with minimal damage. The layered or coated stator seal of the present invention allows for thinner rotor knife edges which would, in the event of a rub, absorb less energy, thereby decreasing the possibility of the rotor experiencing extensive thermal growth that would increase the severity of the rub and wear on such knife edges.

Accordingly the labyrinth seal of the present invention saves considerable weight in that the coated honeycomb structure of the stator can be a larger mesh size and the rotor knife edges can be thinner, providing for a cumulative weight savings and increased durability of the lab seal stator and rotor of the present invention.

The rotor knife edges can be made of nickel alloys or titanium alloys and coated with an abrasive material such as aluminum oxide, chromium oxide, chromium carbine and/or other suitable abrasive coatings. The knife edge can taper down to 0.005 inches to 0.020 inches or more.

In the stator, the honeycomb can be formed of metal foil such as AMS5536, AMS5540 or AMS5542 nickel alloy or stainless steel or other suitable abradeable honeycomb material as desired.

The honeycomb foil or wall thickness preferably is within the range of 0.0015 to 0.004 inches and defines cell widths of 1/16 to ⅛in. or more.

The thin layer or sheet mounted atop the honeycomb structure and below the abradeable coating can be a foil of the same materials as the honeycomb foil materials above and is preferably in the thickness range of 0.0015 to 0.006 in.

The layer of abradeable coating atop the lab stator can be of ceramic material such as zirconium oxide or magnesium zirconate or of other abradeable materials such as aluminum polyester or Ni-chrome polyester.

Such layers of abradeable coating are preferably in the thickness range of 0.010 to 0.040 inches. That is such coating layer is relatively thin so as not to be susceptible to chipping or cracking, yet thick enough to serve for anticipated "normal conditions" rub-in, as discussed above.

As noted above, the layer of abradeable coating can be applied onto a metal foil which is mounted atop the honeycomb structure or such coating can be mounted directly atop the honeycomb structure, in which case some of the coating will penetrate into the cell work of the honeycomb structure.

In a variation of the above, such abradeable coatings can be applied on top of a metallic coating that is applied directly to the top of the honeycomb structure; the metallic coating serving as a bond coat therebetween. A suitable bond coat is an alloy which includes Ni, Co, Cr, Al, and Y.

The above layer of abradeable coating can be applied atop the stator by plasma spraying, by physical vapor deposition, by slurry deposition or other suitable means.

The abradeable coating thus provided, is more yieldable and less damaging to a rotor knife edge than is the honeycomb structure of the prior art, to better preserve rotor and stator and thus the labryrinth seal. Because of such protection as stated above, the rotor knife edge can be thinner and of lighter weight and the honeycomb structure can be made of larger cell sizes, again resulting in weight savings for each lab seal, which can have one or a plurality of rotor (knife edge)-stator pairs. Further, as noted above, the abradable coating seals the top of the honeycomb structure and thus blocks air flow into the honeycomb cells beneath and behind the knife edge and thus reduces losses in seal efficiency. Further, if due to a transient surge in the engine, the rotor knife edge grooves through the stator abradeable coating and underlying foil and into the honeycomb cells, the unifying effect of the coating and foil across the honeycomb cells will limit the grooving damage to such honeycomb cells.

What is claimed is:

1. In a gas turbine, having a labyrinth seal between a rotor and stator therein, in which the stator is surmounted by a honeycomb structure and the rotor has at least one knife edge which is mounted to rotate in close proximity with said honeycomb structure, the improvement comprising, a layer of flowably applied abradeable coating for the rotor knife edge to rub in, for reduced wear to said knife edge said coating being mounted on a support layer, which layer, in turn, is mounted atop said honeycomb structure.

2. The lab seal of claim 1 wherein said support layer is a foil.

3. The labyrinth seal of claim 2 wherein said abradeable coating has a thickness of 0.010 to 0.040 inches.

4. The labyrinth seal of claim 2 wherein said coating is an abradeable ceramic.

5. The labyrinth seal of claim 2 wherein said coating is one selected from the group consisting of zirconium oxide, magnesium zirconate, aluminum polyester and Ni-Cr polyester.

6. The labyrinth seal of claim 1 wherein said layer blocks gas flow into the honeycomb cell structure and below and behind said knife edge and thus reduces losses in gas seal efficiency.

7. The labyrinth seal of claim 2 wherein said layer blocks gas flow into the honeycomb cell structure and below and behind said knife edge and thus reduces losses in gas seal efficiency.

8. The labyrinth seal of claim 1 wherein said rotor knife edge has a thickness variation between 0.005 to 0.020 in.

9. The labyrinth seal of claim 2 wherein said rotor knife edge has a thickness variation between 0.005 to 0.020 in.

10. The labyrinth seal of claim 2 wherein said foil is metallic foil having a thickness between 0.0015 to 0.006 in.

11. The labyrinth seal of claim 2 wherein said honeycomb structure is made of a metal foil having a thickness between 0.0015 to 0.004 in. and in which the cell width varies from 1/16 to ⅛in.

12. The labyrinth seal of claim 2 wherein said foil and said honeycomb structure are both made of nickel alloy foil.

13. The labyrinth seal of claim 2 having a plurality of mating pairs of said annular rotor knife edge in engaging proximity with said annular stator having an abradeable wear surface.

14. The labyrinth seal of claim 13 wherein at least two of said rotor knife edge-stator wear surface pairs are mounted in step-wise, multilevel proximity for increased gas seal efficiency.

* * * * *